US005752989A

United States Patent [19]

Henly et al.

[11] Patent Number: 5,752,989

[45] Date of Patent: May 19, 1998

[54] DIESEL FUEL AND DISPERSANT COMPOSITIONS AND METHODS FOR MAKING AND USING SAME

[75] Inventors: Timothy J. Henly, Maidens; Dennis J. Malfer, Glen Allen, both of Va.

[73] Assignee: Ethyl Corporation, Richmond, Va.

[21] Appl. No.: 754,458

[22] Filed: Nov. 21, 1996

[51] Int. Cl.[6] ..... C10L 1/22; C10L 1/18

[52] U.S. Cl. ..... 44/347; 44/389; 44/400; 44/432; 44/434; 44/443

[58] Field of Search ..... 44/443, 400, 389, 44/434, 347, 432

[56] References Cited

U.S. PATENT DOCUMENTS

| | | | |
|---|---|---|---|
| Re. 32,174 | 6/1986 | Lesuer . | |
| 3,219,666 | 11/1965 | Norman et al. | 44/347 |
| 3,438,757 | 4/1969 | Honnen et al. | 44/432 |
| 3,615,295 | 10/1971 | Manary, Jr. | 44/443 |
| 4,032,304 | 6/1977 | Dorer, Jr. et al. | 44/347 |
| 4,364,743 | 12/1982 | Erner | 44/400 |
| 4,409,000 | 10/1983 | Lesuer | 44/434 |
| 4,460,379 | 7/1984 | Sweeney et al. | 44/434 |
| 4,877,416 | 10/1989 | Campbell | 44/432 |
| 5,004,478 | 4/1991 | Vogel et al. | 44/398 |
| 5,045,088 | 9/1991 | More et al. | 44/400 |
| 5,089,028 | 2/1992 | Abramo et al. | 44/347 |
| 5,162,049 | 11/1992 | Bostick et al. | 44/336 |
| 5,213,585 | 5/1993 | Oppenlaender et al. | 44/434 |
| 5,215,547 | 6/1993 | Bostick et al. | 44/336 |
| 5,242,469 | 9/1993 | Sakakibara et al. | 44/347 |
| 5,366,517 | 11/1994 | Cherpeck | 44/443 |
| 5,366,519 | 11/1994 | Cherpeck | 44/400 |
| 5,405,417 | 4/1995 | Cunningham | 44/322 |
| 5,405,419 | 4/1995 | Ansari et al. | 44/412 |
| 5,425,790 | 6/1995 | Liotta, Jr. et al. | 44/443 |
| 5,433,755 | 7/1995 | Mulard et al. | 44/330 |
| 5,516,342 | 5/1996 | Cherpeck | 44/443 |
| 5,569,310 | 10/1996 | Cherpeck | 44/443 |

FOREIGN PATENT DOCUMENTS

| | | |
|---|---|---|
| 2089833 | 8/1993 | Canada . |
| WO94/14929 | 7/1994 | WIPO . |

*Primary Examiner*—Ellen M. McAvoy
*Attorney, Agent, or Firm*—Dennis H. Rainear; Thomas Hamilton

[57] ABSTRACT

A diesel fuel additive composition comprising a mixture of a dispersant and a carrier, preferably a liquid carrier fluid. The dispersant comprises at least one member of the group consisting of polyalkylene succinimides and polyalkylene amines, the polyalkylene succinimides being the reaction product of polyalkylene succinic anhydride and a polyamine, the polyalkylene amine being the reaction product of a polyalkylene moiety and amine selected from the group consisting of monoamine and polyamine. The carrier comprises at least one oxygenate selected from the group consisting of polyalkoxylated ether, polyalkoxylated phenol, polyalkoxylated ester and polyalkoxylated amine. The additive composition reduces injector deposits in internal combustion-compression ignition engines. Diesel fuels containing a major portion of a hydrocarbon-based compression ignition fuel and a minor portion of the diesel fuel additive composition, as well as methods of making and using these diesel fuels are also included in the present invention.

42 Claims, No Drawings

DIESEL FUEL AND DISPERSANT COMPOSITIONS AND METHODS FOR MAKING AND USING SAME

BACKGROUND OF THE INVENTION

I. Field of the Invention

The present invention relates to new compositions, methods for making diesel fuel, and methods for minimizing deposits in compression ignition engines powered by diesel fuel.

II. Background Discussion

It has long been desired to maximize fuel economy and power in diesel engines while enhancing acceleration, preventing knocking, and preventing hesitation. It has been known to enhance gasoline powered engine performance by employing dispersants to keep valves and fuel injectors clean. However, it was unpredictable, if the dispersants used with gasoline would be effective in diesel fuel. The reasons for this unpredictability lie in the many differences between how diesel engines and gasoline engines operate and the chemical differences between diesel fuel and gasoline.

Diesel engines are known as compression ignition engines. Gasoline engines are known as spark ignition engines. These two types of engines differ greatly in ignition and power control. Usually the diesel engine draws a full charge of air into the combustion chamber during the engine's intake stroke. Then the air is compressed to a compression ratio between 12:1 and 20:1 during a compression stroke. This high compression ratio typically raises the temperature of the air to 1000° F. (about 540° C.). Just before the top center of the compression stroke, fuel is sprayed into the combustion chamber. The high air temperature quickly ignites the fuel to produce combustion products. The combustion products expand to produce power and exhaust to complete the cycle.

In contrast, a gasoline powered engine makes an explosive mixture of air and volatile liquid gasoline external to the engine's cylinder. Then the mixture is typically injected into the cylinder and then compressed to a compression ratio of only 4:1 to 10:1. This is about 200° F. (about 110° C.) below ignition temperature. The compressed mixture is then ignited by an electric spark to explode the mixture.

Diesel fuel contains hydrocarbons having higher boiling points than those of gasoline. Diesel fuel generally has a distillation range between 320° F. to 715° F. (about 160° C. and 380° C.). Gasoline generally distills below this temperature range, e.g., between about 100° F. to 400° F. (about 40° C. and 205° C.). Diesel fuels generally contain more sulfur and nitrogen than gasoline. Moreover, gasoline is designed to resist burning when compressed in the absence of a spark. Such burning is undesired because it causes knocking. Diesel fuel is the opposite. Diesel fuel must ignite spontaneously and quickly (within 1 to 2 milliseconds) without a spark. The time lag between the initiation of injection and the initiation of combustion is called ignition delay. In high-speed diesel engines, a fuel with a long ignition delay tends to produce rough operation and knocking. Two major factors affect ignition delay: a mechanical factor and a chemical factor.

The mechanical factor is influenced by such things as compression ratio, motion of the air charge during ignition and ability of the fuel injector to atomize fuel. The differences between diesel engines and gasoline engines are reflected by how their mechanical factors are affected differently by changing the dimensions of their mechanical parts. For example, the larger the cylinder diameter of a diesel engine, the simpler the development of good combustion. In contrast, the smaller the cylinder of a gasoline engine, the less the danger of premature detonation of fuel. High intake-air temperature and density (provided by a supercharger) aid combustion in a diesel engine. In contrast, high intake-air temperature and density (provided by a supercharger) increases the tendency to knock, necessitating higher octane fuel, in a gasoline engine.

The chemical factor is influenced by such things as the fuel's auto ignition temperature, specific heat, density, and other physical properties. The ability of a diesel fuel to ignite quickly after injection into a cylinder is known as its cetane number. The ability of a gasoline to resist burning prior to introduction of a spark is known as its octane number. A higher cetane number is equivalent to a lower octane number. Diesel fuels generally have a clear cetane number, i.e., a cetane number when devoid of any cetane improver, in the range of 40 to 60.

To minimize ignition delay, it is necessary to enhance the mechanical factor by maintaining the fuel injector's ability to precisely atomize fuel by keeping the injectors clean. However, it is possible that employing gasoline dispersants in diesel fuel might maintain injector cleanliness to enhance the mechanical factor, but if they harmed the chemical factor this could achieve an overall negative result. Also, a dispersant which kept engine intake valves and fuel injectors clean in a gasoline engine might not keep the fuel injectors clean in a diesel engine (diesel engines generally lack the valves commonly associated with gasoline engines). Diesel fuel injectors are subjected to much higher temperature, e.g., 1000° F. (about 540° C.), and pressure than gasoline engine intake valves. Normal engine intake valves generally operate at temperatures in the range of about 345° F. to about 575° F. (about 175° C. to 300° C.). Diesel fuel injectors are also subjected to higher temperatures than gasoline injectors.

Thus, in view of the above described differences in diesel engine and gasoline engine operation and fuels, experimentation was needed to find effective diesel fuel dispersants.

SUMMARY OF THE INVENTION

It is a first object of the present invention to provide a diesel fuel which contains dispersant and carrier.

It is another object of the invention to provide an additive composition which contains dispersant and carrier for adding to diesel fuel.

It is another object of the invention to provide a method of operating a pressure ignition-internal combustion engine with diesel fuel which contains dispersant and carrier.

It is another object of the invention to provide a method of making diesel fuel which contains dispersant and carrier.

The present invention relates to a diesel fuel composition comprising a major portion of a hydrocarbon-based compression ignition fuel and a minor portion of an additive composition comprising a mixture of a dispersant and a carrier. The dispersant comprises at least one member of the group consisting of polyalkylene succinimides and polyalkylene amines. Preferably the dispersant comprises at least one of the polyalkylene succinimides. The polyalkylene succinimides are the reaction product of polyalkylene succinic anhydride and a polyamine. The polyalkylene amines are the reaction product of a polyalkylene moiety and a second amine selected from the group consisting of ammonia, monoamine and polyamine. The carrier comprises at least one oxygenate selected from the group consisting of polyalkoxylated ether, polyalkoxylated phenol, polyalkoxylated ester and polyalkoxylated amine. Preferably the carrier comprises at least one of the polyalkoxylated ethers, polyalkoxylated phenols, or polyalkoxylated amines. The carrier is a liquid or a solid, e.g., wax. Where the dispersant comprises polyalkylene succinimide in the absence of polyalkylene amine, and the carrier comprises polyalkoxylated amine, then the carrier also comprises at least one member of the group consisting of polyalkoxylated ether, polyalkoxylated phenol, and polyalkoxylated ester; when the dispersant comprises the polyalkylene succinimide, in the absence of the polyalkylene amine, and the carrier comprises polyalkoxylated ether, the additive has an absence of a polymer or copolymer of an olefinic hydrocarbon and/or an absence of ester; and when the dispersant is polyalkylene amine in the absence of polyalkylene succinimide and the carrier comprises polyalkoxylated ether then the carrier further comprises at least one member of the group consisting of the polyalkoxylated phenol, the polyalkoxylated ester and the polyalkoxylated amine.

The additive composition reduces injector deposits in internal combustion-compression ignition engines.

The present invention also relates to a diesel fuel additive composition comprising the above described dispersant and carrier.

In its method respects, the present invention provides methods for operating a pressure ignition-internal combustion engine with the diesel fuels of the present invention. The present invention also provides methods for making the diesel fuels of the present invention.

These and other objects and advantages of the present invention will become apparent from the following description of the invention.

DETAILED DESCRIPTION OF THE PREFERRED EMBODIMENTS

I. Dispersants

A. Polyalkylene Succinimides

The polyalkylene succinimide is made by reacting a polyalkylene succinic anhydride with an amine.

The polyalkylene succinic anhydride has the following Formula I:

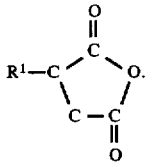

I

In Formula I, $R^1$ is a polyalkenyl radical having a number average molecular weight from about 600 to about 3,000, preferably about 900 to about 1,500. Unless indicated otherwise molecular weights in the present specification are number average molecular weights. The polyalkenyl radical contains from about 40 to 300 carbon atoms, preferably about 60 to about 100 carbon atoms. The alkenyl groups are polyolefins made from olefins, typically 1-olefins, containing 2 to 10 carbon atoms. Representative examples of suitable olefins include ethylene, propylene, butylene, isobutylene, pentene, hexene, octene, decene and higher olefins or copolymers thereof. Isobutylene is especially preferred. When the polyalkenyl radical is a homopolymer of polyisobutylene, it contains from about 10 to about 60 isobutylene groups, preferably from about 20 to about 30 isobutylene groups. The polyolefins are made by conventional catalytic oligomerization of the olefin.

The polyalkylene succinic anhydrides are made by known techniques. The polyalkylene succinic anhydride is made from a mixture of polyolefins and maleic anhydride which are heated to a temperature of from 150° to 250° C. (300° F. to 480° F.), optionally, with the use of a catalyst such as chlorine or peroxide. Approximately one mol of maleic anhydride is reacted per mol of polyalkylene such that the resulting polyalkenyl succinic anhydride has about 1 succinic anhydride group per polyalkylene substituent, preferably 0.8 to 0.9 succinic anhydride groups for each polyalkylene substituent. The weight ratio of succinic anhydride groups to alkylene groups ranges from about 0.5 to about 3.5, preferably from about 1 to about 1.1. Another method of making the polyalkylene succinic anhydrides is described in U.S. Pat. No. 4,234,435, which is incorporated herein by reference in its entirety.

The amine (to be reacted with the polyalkylene succinic anhydride) has the following Formula II:

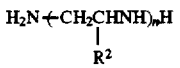

II in which $R^2$ is a hydrogen atom or a low molecular weight alkyl group having from 1 to 6 carbon atoms, and n is an integer ranging from 1 to about 6. Preferably $R^2$ is a hydrogen atom or an alkyl group having from 1 to 2 carbon atoms. Preferably in Formula II n is an integer ranging from 2 to 4. Representative examples of $R^2$ alkyl groups include methyl, ethyl, propyl or butyl. Representative examples of suitable polyamines include ethylene diamine, propylene diamine, butylene diamine, diethylene triamine, triethylene tetramine, tetraethylene pentamine, pentaethylene hexamine, dipropylene triamine and tripropylene tetramine. The polyamine can also be a polymer or copolymer of any one of the foregoing polyamines ranging in molecular weight from about 100 to about 600.

Generally, the alkylene succinic anhydride of Formula I and the amine of Formula II are reacted together at an mol ratio of about 1 to about 2 mols of polyalkylene succinic anhydride for 1 mol of the amine. Preferably, the mol ratio is about 1.5 to about 2 mols of polyalkylene succinic anhydride of Formula I for 1 mol of the amine of Formula II. Thus, typical polyalkylene succinimides have the Formulas III and IV:

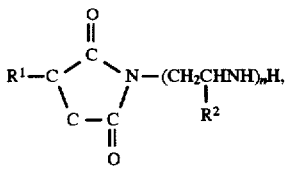

III

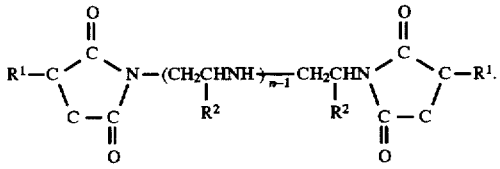

IV

Procedures for making the polyalkenyl succinimide are described in U.S. Pat. No. 3,219,666 and U.S. Pat. No. 4,098,585, which are herein incorporated by reference in their entirety.

B. Polyalkylene Amines

The polyalkylene amine is a straight or branched chain amine having at least one basic nitrogen atom wherein the polyalkylene group has a number average molecular weight of about 600 to about 3,000. Preferably, the polyalkylene group will have a number average molecular weight in the range of about 750 to about 2,200, and more preferably, in the range of about 900 to about 1,500.

The polyalkylene group will be relatively free of aliphatic unsaturation, i.e., ethylenic and acetylenic, particularly acetylenic unsaturation. The polyalkylene group will generally be branched chain. When employing a branched-chain polyalkylene amine, the polyalkylene group is preferably derived from polymers of $C_2$ to $C_6$ olefins, more preferably isobutylene.

The amine component of the polyalkylene amines may be derived from ammonia, a monoamine or a polyamine. The monoamine or polyamine component embodies a broad class of amines having from 1 to about 12 amine nitrogen atoms and from 1 to about 40 carbon atoms, preferably with a carbon to nitrogen ratio between about 1:1 and 10:1. Generally, the polyamine will contain from 2 to about 12 amine nitrogen atoms and from 2 to about 40 carbon atoms. In most instances, the amine component is not a pure single product, but rather a mixture of compounds having a major quantity of the designated amine.

The monoamines preferably are primary or secondary monoamines which contain 1 nitrogen atom and 1 to about 20 carbon atoms, preferably 1 to about 10 carbon atoms. The primary or secondary monoamine may also contain one or more oxygen atoms.

Preferred polyalkylene amines suitable for use in the present invention are polyalkylene amines having the following Formula V:

$$R^3NH\left(CH_2\underset{\substack{|\\ R^2}}{C}HNH\right)_nR^4. \qquad \text{V}$$

In Formula V, $R^2$ and n are as defined above. $R^3$ is polyalkenyl radical having a number average molecular weight of about 600 to about 3,000. $R^4$ is H or a polyalkylene radical having a molecular weight of about 600 to 3,000. Preferably, $R^3$ is a polyalkenyl radical having a molecular weight of about 750 to about 2,200, more preferably, from about 900 to about 1,500. Preferably $R^4$ is H or a polyalkenyl radical having a molecular weight of about 750 to about 2,200, more preferably, from about 900 to about 1,500. Particularly preferred branched-chain polyalkylene amines include polyisobutenyl ethylene diamine and polyisobutyl amine, wherein the polyisobutyl group is substantially saturated.

Where the amine is a polyamine, the polyamine may optionally be substituted in addition to the above-mentioned polyalkenyl radical-substitution. In such a substituted polyamine, the substituents are found at any atom capable of receiving them. The substituted atoms, e.g., substituted nitrogen atoms, are generally geometrically unequivalent. Consequently, the substituted amines finding use in the present invention can be mixtures of mono- and polysubstituted polyamines with substituent groups situated at equivalent and/or unequivalent atoms. Typically, the optional substituent is at least one substituent selected from the group consisting of: (A) hydrogen, (B) hydrocarbyl groups of from 1 to about 10 carbon atoms, (C) acyl groups of from 2 to about 10 carbon atoms, and (D) monoketo, monohydroxy, mononitro, monocyano, lower alkyl and lower alkoxy derivatives of (B) and (C). "Lower" as used in terms like lower alkyl or lower alkoxy, means a group containing from 1 to about 6 carbon atoms. At least one of the substituents on one of the basic nitrogen atoms of the polyamine is hydrogen, e.g., at least one of the basic nitrogen atoms of the polyamine is a primary or secondary amino nitrogen. The monoamines can have optional substitution.

II. Carriers

The dispersant products of this invention are used in combination with a diesel fuel soluble carrier. Such carriers can be of various types, such as liquids or solids, e.g., waxes. Typically liquid carriers include liquid polyalkoxylated ethers (also known as polyalkylene glycols or polyalkylene ethers), liquid polyalkoxylated phenols, liquid polyalkoxylated esters, liquid polyalkoxylated amines, and mixtures thereof.

The liquid carriers preferably have viscosities in their undiluted state of at least about 40 cSt at 40° C. and at least about 5 cSt at 100° C. In addition, the liquid carriers used in the practice of this invention preferably have viscosities in their undiluted state of at most about 400 cSt at 40° C. and no more than about 50 cSt at 100° C. More preferably, their viscosities will not exceed about 300 cSt at 40° C. and will not exceed about 40 cSt at 100° C. The most preferred liquid carriers will have viscosities of no more than about 200 cSt at 40° C., and no more than about 30 cSt at 100°.

A. Polyalkoxylated Ethers

The polyoxyalkylene compounds which are among the preferred carriers for use in this invention are fuel-soluble polyalkoxylated ethers which can be represented by the following Formula VI:

$$R^5\left(R^6-O\right)_uR^7. \qquad \text{VI}$$

In Formula VI, $R^5$ is typically a hydrogen, alkoxy, cycloalkoxy, hydroxy, amino, hydrocarbyl (e.g., alkyl, cycloalkyl, aryl, arylalkyl, etc.), amino-substituted hydrocarbyl, or hydroxy-substituted hydrocarbyl group. Preferably $R^5$ is selected from the group consisting of a hydrogen, alkyl having from 1 to 6 carbon atoms, and hydroxy-substituted hydrocarbyl group having from 1 to 6 carbon atoms. $R^6$ is an alkylene group having 2–10 carbon atoms (preferably 2–4 carbon atoms). $R^7$ is typically a hydrogen, alkoxy, cycloalkoxy, hydroxy, amino, hydrocarbyl (e.g., alkyl, cycloalkyl, aryl, alkylaryl, aralkyl, etc.), amino-substituted hydrocarbyl, or hydroxy-substituted hydrocarbyl group. Preferably, $R^7$ is a member selected from the group consisting of a hydrogen and alkyl having from 10–18 carbon atoms, more preferably 12–14 carbon atoms. Parameter u is an integer from 1 to about 500 and preferably in the range of from 3 to about 120 representing the number (usually an average number) of repeating alkyleneoxy groups. In compounds having multiple —$R^6$—O— groups, $R^6$ can be the same or different alkylene group and where different, can be arranged randomly or in blocks. The molecular weight of the polyoxyalkylene compounds used as carriers is preferably in the range from about 200 to about 5000, more preferably from about 1000 to about 4500, and most preferably from above about 1000 to about 2000.

One useful sub-group of polyoxyalkylene compounds is comprised of the hydrocarbyl-terminated poly(oxyalkylene) monools, i.e., "capped" poly(oxyalkylene) glycols, such as are referred to in the passage at column 6, line 20 to column 7, line 14 of U.S. Pat. No. 4,877,416 and references cited in that passage. The passage being incorporated herein by reference in its entirety.

A particularly preferred sub-group of polyoxyalkylene compounds is comprised of one or a mixture of monools formed by propoxylation of one or a mixture of alcohols having about 10 to about 18 carbon atoms, preferably about 12 to about 14 carbon atoms.

Preferred polyoxyalkylene compounds are poly (oxyalkylene) glycol compounds and monoether derivatives thereof comprised of repeating units formed by reacting an alcohol or polyalcohol with an alkylene oxide, such as propylene oxide and/or butylene oxide with or without use of ethylene oxide. Preferably only one type of alkylene oxide is employed in a given compound. Especially preferred are such polyoxyalkylene compounds in which at least 80 mol % of the oxyalkylene groups in the molecule are derived from 1,2-propylene oxide. Details concerning preparation of such poly(oxyalkylene) compounds are referred to, for example, in Kirk-Othmer, *Encyclopedia of Chemical Technology*, Third Edition, Vol. 8, pages 633–645 (John Wiley & Sons, 1982), and in references cited therein, the foregoing excerpt of the Kirk-Othmer encyclopedia being incorporated herein by reference in its entirety. U.S. Pat. Nos. 2,425,755; 2,425,845; 2,448,664; and 2,457,139 also describe such procedures, and are also incorporated herein by reference in their entirety.

The polyoxyalkylene compounds used pursuant to this invention will contain a sufficient number of branched oxyalkylene units (e.g., methyldimethyleneoxy units and/or ethyldimethyleneoxy units) to render the poly(oxyalkylene) compound diesel fuel soluble.

B. Polyalkoxylated Phenols

The polyalkoxylated phenols have the Formula VII:

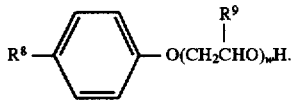

VII

In this formula, $R^8$ is selected from the group consisting of hydrogen, hydroxy, and alkyl having from 1 to 12 carbon atoms (preferably 8 to 12 carbon atoms). $R^9$ is selected from the group consisting of hydrogen or alkyl having 1 to 6 carbon atoms (preferably 1 to 2 carbon atoms), w is an integer from 2 to 50. Preferably w is an integer from 10 to about 40. $R^9$ may be the same or different in successive repeating units of Formula VII shown as Formula VIII:

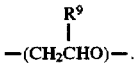

VIII

The average molecular weight of the polyalkoxylated phenols is preferably from about 200 to about 4000, more preferably from about 500 to about 1000.

Polyalkoxylated phenols are made by alkoxylating, i.e., reacting, an epoxide shown by the following Formula IX:

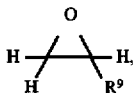

IX with phenol or an alkyl phenol. In Formula IX, $R^9$ is as defined above.

C. Polyalkoxylated Esters

The carrier may contain a polyalkoxylated ester made by known techniques or readily available from commercial sources. The ester is based on an ester of aliphatic or aromatic carboxylic acids, i.e., a mono-, di-, tri- or tetra-carboxylic acid. The ester typically contains over 22 carbon atoms and has a molecular weight ranging from about 500 to about 4,000, preferably, about 1,000 to about 2,000. Preferred polyalkoxylated esters have the following Formula X:

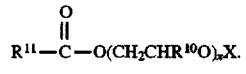

X

In Formula X, the moiety X is selected from the group consisting of H and $C_1$ to $C_{16}$ alkyl, x is an integer from about 1 to 500, $R^{10}$ is selected from the group consisting of H and $C_1$ to $C_4$ alkyl, and $R^{11}$ is selected from the group consisting of H and $C_1$ to $C_{14}$ alkyl, or, alternately to form a succinate, $R^{11}$ is a moiety of Formula XI:

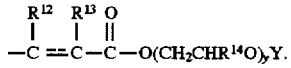

XI

In Formula XI, at most one of $R^{12}$ and $R^{13}$ is hydrogen and at least one of $R^{12}$ and $R^{13}$ is selected from the group consisting of groups of chemical character (i.e., a non-polar character) which render the succinate soluble in the diesel fuel. Thus, at least one of $R^{12}$ and $R^{13}$ is selected from the group consisting of alkyl, aryl, arylalkyl, and alkenyl groups of 2 to about 18 carbon atoms, preferably about 8 to about 16 carbon atoms, and most preferably about 8 to about 12 carbon atoms. $R^{14}$ is selected from the group consisting of H and $C_1$ to $C_4$ alkyl, preferably $R^{14}$ is selected from the group consisting of H and $C_1$ to $C_2$ alkyl. Y is selected from the group consisting of H and $C_1$–$C_{18}$ alkyl, preferably H and $C_8$–$C_{12}$ alkyl, and y is an integer from 1 to about 10. Preferably y is an integer from 2 to about 6. From Formula XI it will be understood that the bond between the attachment points of $R^{12}$ and $R^{13}$ to the succinate may be either a single or double bond, as indicated by the broken line; the double bond variations being maleates.

Succinates may be produced through the general reaction of the succinic anhydride or succinic acid bearing the desired $R^{12}$ and $R^{13}$ groups with alcohol(s) bearing the desired $-(CH_2CHR^{10}O)_xX$ and $-(CH_2CHR^{14}O)_yY$ groups. The reaction may be acid catalyzed and normally proceeds under heating. The succinates can also be made by alkoxylating the succinic anhydride or succinic acid. For example, polyalkoxylated esters are made by alkoxylating, i.e., reacting, the epoxide shown by the Formula IX:

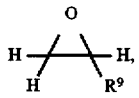

IX with the succinic anhydride or succinic acid. In Formula IX, $R^9$ is as defined above.

Thus, the succinates have the general Formula XII:

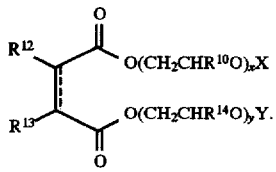

XII

The aromatic or aliphatic esters of Formula X can be made by alkoxylating an acid or by reacting the acid with a polyalkoxylated alcohol. For example, polyalkoxylated esters are made by alkoxylating, i.e., reacting, the epoxide shown by the Formula IX:

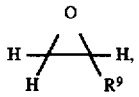

IX with the acid. In Formula IX, $R^9$ is as defined above. Polyalkoxylated esters are commercially available, for example, from AKZO Chemicals, Inc., Chicago, Ill. under the ETHOFAT trademark.

There are other ways to make the ester which are known in the art. These methods are described in Kirk-Othmer,

*Encyclopedia of Chemical Technology*, Vol. 9, pages 291–309 (John Wiley and Sons, 1980). Such methods include direct synthesis by reacting an organic alcohol and a carboxylic acid substituted benzene with elimination of water. See Kirk-Othmer, *Encyclopedia of Chemical Technology*, Vol. 9, pages 306–307 (John Wiley & Sons, New York, 1980). Additionally, a method for making the esters is described in U.S. Pat. No. 4,032,550 and in U.S. Pat. No. 4,032,304 which are both incorporated herein by reference in their entirety.

D. Polyalkoxylated Amines

The polyalkoxylated amines employed in compositions of the present invention have the Formula XIII:

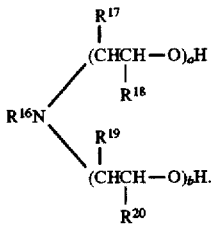

XIII

In Formula XIII, $R^{16}$ is preferably an alkyl or alkenyl group containing from about 8 to about 30 carbon atoms and especially from about 10 to about 25 carbon atoms. Alternatively, $R^{16}$ may be a radical of Formula XIV:

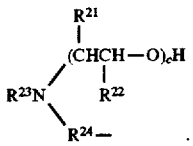

XIV

In Formula XIV $R^{23}$ is an alkyl or alkenyl group containing from about 8 to about 30, preferably from about 10 to about 25, carbon atoms. Illustrative $R^{16}$ and, if present, $R^{23}$ groups are octyl, decyl, dodecyl, tridecyl, tetradecyl, octadecyl, eicosyl, tricontanyl, dodecenyl, octadecenyl and octadecadienyl.

The group $R^{24}$, if present, is an alkylene radical containing from 2 to about 6 carbon atoms. It may be a straight-chain or branched-chain radical. Most often it is an ethylene, propylene or trimethylene radical, especially trimethylene.

The groups $R^{17}$, $R^{18}$, $R^{19}$, $R^{20}$, and, if present, $R^{21}$ and $R^{22}$ are each hydrogen or an alkyl group which contains up to about 7 carbon atoms. Each of these groups is preferably hydrogen or methyl. Most often, all four of the $R^{17-20}$ groups are hydrogen or three are hydrogen and the fourth is methyl; and $R^{21}$ and $R^{22}$, if present, are both hydrogen or one is hydrogen and the other is methyl.

The integers a and b and, if present, c may each be from 1 to about 75. They are most often from 1 to about 10 and especially from 1 to about 5. Preferably, both a and b and, if present, c are 1.

Suitable amines having Formula XIII may be obtained by reacting a primary amine, or a diamine containing one primary and one secondary amine group, with ethylene oxide or propylene oxide. The especially preferred amines are the "ETHOMEENS" and "ETHODUOMEENS," a series of commercial mixtures of ethoxylated fatty amines available from AKZO Chemicals, Inc., Chicago, Ill. in which each of a, b and c (if applicable) is between 1 and about 50. Suitable "ETHOMEENS" include "ETHOMEEN C/12," "ETHOMEEN S/12," "ETHOMEEN T/12," "ETHOMEEN O/12" and "ETHOMEEN 18/12." In these compounds each of $R^{17}$, $R^{18}$, $R^{19}$, and $R^{20}$ is hydrogen and a and b are each 1. In "ETHOMEEN C/12," "S/12" and "T/12" $R^{16}$ is a mixture of alkyl and alkenyl groups derived, respectively, from coconut oil, soybean oil and tallow, and in "ETHOMEEN O/12" and "18/12" it is respectively oleyl and stearyl. In the corresponding "ETHODUOMEENS," $R^{16}$ has Formula XIV, $R^{23}$ is one of the groups or group mixtures identified above for $R^{16}$, $R^{21}$ and $R^{22}$ are each hydrogen, $R^{24}$ is trimethylene, and a, b, and c are each 1. As will be apparent from a consideration of the fats and oils from which these amines are derived, $R^{16}$ or $R^{23}$ is in each instance an aliphatic hydrocarbon group containing about 12 to about 28 carbon atoms.

III. Additive Proportions

The proportion of the carrier used relative to the dispersant in the preferred additive packages and diesel fuel compositions of this invention is such that the diesel fuel composition when consumed in a diesel engine results in improved injector cleanliness as compared to injector cleanliness of the same engine operated on the same composition except for being devoid of the carrier. Thus in general, the weight ratio of fluid to dispersant on an active ingredient basis, will usually fall within the range of about 0.3:1 to about 2:1, and preferably within the range of about 0.5:1 to about 1:1. The active ingredient basis excludes the weight of (i) unreacted components such as polyolefin and phenolic compounds associated with and remaining in the product as produced and used, and (ii) solvent(s), if any, used in the manufacture of the dispersant either during or after its formation but before addition of the carrier.

Preferably, the carrier is a liquid carrier fluid. Typically, the additive concentrates of this invention contain from about 30 to about 80 weight percent, preferably from about 50 to about 70 weight percent of the dispersant on an active ingredient basis (see the immediately preceding paragraph for a definition of this term). Moreover, the additive concentrates of this invention contain from about 20 to about 70 weight percent, preferably from about 30 to about 50 weight percent of the liquid carrier fluid.

In some cases, the polyalkylene succinimide dispersant or polyalkylene amine dispersant can be synthesized in the carrier liquid. In other instances, the preformed dispersant is blended with a suitable amount of the carrier liquid. If desired, the dispersant can be formed in a suitable solvent or carrier liquid and then blended with an additional quantity of the same or a different carrier liquid.

If desired, the additive concentrates may contain small amounts (e.g., a total of at most about 10 weight percent, preferably a total of at most about 5 weight percent, based on the total weight of the additive concentrate), of one or more fuel-soluble antioxidants, demulsifying agents, rust or corrosion inhibitors, metal deactivators, marker dyes, and the like.

When formulating the fuel compositions of this invention, the additives are employed in amounts sufficient to reduce or inhibit deposit formation in a diesel engine, i.e., compression ignition-internal combustion engine. Thus, the fuels will contain minor amounts of the dispersant and of the carrier (proportioned as above) that control or reduce formation of engine deposits, especially injector deposits in compression ignition-internal combustion engines. Generally speaking the diesel fuels of this invention will contain, on an active ingredient basis as defined above, an amount of the dispersant in the range of about 50 to about 200 ppmw (parts by weight of additive per million parts by weight of fuel plus additive), and preferably in the range of about 70 to about 170 ppmw. Also, the fuel compositions will contain, on an active ingredients basis, an amount of the carrier in the range of about 50 ppmw to about 200 ppmw, and preferably in the range of about 50 ppmw to about 100 ppmw.

The additives used in formulating the preferred fuels of this invention can be blended into the base diesel fuel individually or in various sub-combinations. However, it is definitely preferable to blend all of the components concurrently using an additive concentrate of this invention as this takes advantage of the mutual compatibility afforded by the combination of ingredients when in the form of an additive concentrate. Also use of a concentrate reduces blending time and lessens the possibility of blending errors.

Conventional additives and blending agents for diesel fuel may be present in the fuel compositions of this invention. For example, the fuels of this invention may contain conventional quantities of such conventional additives such as cetane improvers, friction modifiers, detergents, dispersants other than those described above, antioxidants, heat stabilizers, and the like. Similarly the fuels may contain suitable amounts of conventional fuel blending components such as methanol, ethanol, dialkyl ethers, and the like.

This invention is applicable to the operation of both stationary diesel engines (e.g., engines used in electrical power generation installations, in pumping stations, etc.) and in ambulatory diesel engines (e.g., engines used as prime movers in automobiles, trucks, road-grading equipment, military vehicles, etc.). Accordingly, the present invention includes a method for reducing the amount of injector deposits of a diesel engine which comprises supplying to and burning in the diesel engine a diesel fuel composition comprising a major amount of a hydrocarbon-based compression ignition fuel and a minor portion of the additive composition of the present invention.

EXAMPLES

The practice and advantages of this invention are demonstrated by the following examples which are presented for purposes of illustration and not limitation.

The effectiveness of the present invention in improving injector cleanliness in diesel engines was tested. These tests compare diesel fuels containing the additives of both dispersant and carrier liquid of the present invention and diesel fuel containing only dispersant.

The tests were run in a multi-cylinder diesel engine. The engine was operated on a typical commercial diesel fuel as a base fuel with only the dispersant and then the injector deposits were measured. The engine was then operated on a fuel containing another portion of the same base fuel, plus both the dispersant and carrier liquid according to the present invention, and the injector deposits were measured. This procedure was repeated alternating between base fuel with dispersant and base fuel with dispersant and carrier liquid to eliminate, or at least substantially minimize, fluctuations in results from one run to the next. The test employed was a Cummins L-10 Test. Cummins Corp. is an engine manufacturer located in Columbus, Ind. This test is designed to provide a test cycle capable of producing diesel injector deposits. Unless indicated otherwise, the injector deposit test employs two engines (Cummins L-10 engines) connected in series front-to-rear with a driveshaft. While one engine is powering (approximately 55 to 65 horsepower), the other engine is closed throttle motoring.

The engines run for 125 hours. Coolant in/out temperatures and fuel temperatures are controlled to obtain repeatable results. The engine fuel system is then flushed to remove residual additive and the injectors with their respective plungers are removed. Without removing the plunger from the injectors, the injectors are flowed on a flow stand to determine percent Flow Rate Loss. The plungers are then carefully removed, so as not to disturb the deposits, from the injector bodies. Then the plunger minor diameter deposits are rated by the CRC (Coordinated Research Council, Atlanta, Ga.) rating method Manual #18. A higher rating indicates more deposits. By the CRC rating system, 0 represents new and 100 represents extremely dirty.

The fuels, additives and test results in terms of average Flow Rate Loss and average CRC Rating employing the Cummins L-10 Test are presented on the following Tables 1–3. Tables 1–3 list concentrations of ingredients as pounds per thousand barrels.

The ingredients employed in these examples include the following. The base diesel fuel was CAT 1H high sulfur diesel fuel available manufactured by Howell Hydrocarbon, Houston, Tex. The polyalkylene succinimide A employed was polyisobutylene succinimide A made by reacting polyisobutylene succinic anhydride number average molecular weight 900 with tetraethylene pentamine at a mol ratio of 1.6:1, respectively. The polyisobutylene succinimide B was made by reacting polyisobutylene succinic anhydride (number average molecular weight 1300) with tetraethylene pentamine at a mol ratio of 1.8:1, respectively. The polyglycol is a $C_{13}$ alcohol primary alcohol reacted with polypropylene oxide molecular weight between 1600 and 1700. The succinate has the following Formula XV.

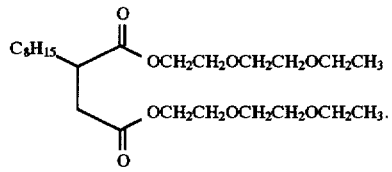

XV

Comparative Examples 1–2

TABLE 1 shows averages of test results from six (6) individual injectors using polyisobutylene succinimide A alone in diesel fuel for each of Comparative Examples 1 and 2.

TABLE 1

| | Flow Rate Loss | CRC Rating |
|---|---|---|
| Comparative Example 1 40 PTB Polyisobutylene succinimide A | 2.3 | 14.9 |
| Comparative Example 2 60 PTB Polyisobutylene succinimide A | 1.8 | 11.9 |

Examples 1–3

Example 1 employed polyisobutylene succinimide A with polyglycol in diesel fuel. Example 2 employed the polyisobutylene succinimide A with succinate in diesel fuel. TABLE 2 shows the average of test results from six (6) injectors for each of Examples 1 and 2.

TABLE 2

| | Flow Rate Loss | CRC Rating |
|---|---|---|
| Example 1<br>40 PTB polyisobutylene succinimide A<br>20 PTB polyglycol | 3.0 | 12.4 |
| Example 2<br>40 PTB Polyisobutylene succinimide A<br>20 PTB succinate | 3.2 | 11.0 |

Comparison of Comparative Example 1 and Examples 1 and 2 show the polyglycol and succinate, respectively, improved the CRC Rating.

Comparative Example 3 and Example 3

The following tests were performed according to the above procedure. These tests employed one engine attached to a dynamometer rather than two engines attached to each other. The fuels, additives and average of six (6) individual injectors are listed in TABLE 3.

TABLE 3

| | Flow Rate Loss | CRC Rating |
|---|---|---|
| Comparative Example 3<br>40 PTB Polyisobutylene succinimide A | 3.4 | 11.4 |
| Example 3<br>40 PTB Polyisobutylene succinimide A<br>20 PTB polyglycol | 3.1 | 8.7 |

The data of Table 3 shows the polyglycol of Example 3 improved the CRC rating.

In view of the present disclosure, it is apparent that it is possible to make many modifications to the above described embodiments without departing from the spirit and scope of the present invention. Thus, the present invention is not limited by the foregoing description. Rather it is set forth by the claims appended hereto.

What is claimed is:

1. A diesel fuel composition comprising a mixture of:

a major portion of a hydrocarbon-based compression ignition fuel;

a minor portion of an additive comprising a dispersant and a carrier;

the dispersant comprises at least one member of the group consisting of polyalkylene succinimides and polyalkylene amines, the polyalkylene succinimides being the reaction product of polyalkylene succinic anhydride and a first amine selected from the group consisting of polyamine, the polyalkylene amine being the reaction product of a polyalkylene moiety and a second amine selected from the group consisting of ammonia, monoamine and polyamine;

the carrier comprising at least one oxygenate selected from the group consisting of polyalkoxylated ether, polyalkoxylated phenol, polyalkoxylated ester and polyalkoxylated amine, wherein the polyalkoxylated phenol has the Formula VII:

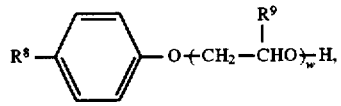

VII wherein $R^8$ is selected from the group consisting of hydrogen and alkyl having from 1 to 12 carbon atoms, each $R^9$ is independently selected from the group consisting of hydrogen or alkyl having 1 to 6 carbon atoms, w is an integer from 2 to 50; wherein (a) when the carrier comprises polyalkoxylated amine, the dispersant comprises polyalkylene amine;

(b) when the dispersant comprises the polyalkylene succinimide, in the absence of the polyalkylene amine, and the carrier comprises polyalkoxylated ether, the additive has an absence of a polymer or copolymer of an olefinic hydrocarbon or an absence of ester;

(c) when the dispersant is polyalkylene amine in the absence of polyalkylene succinimide and the carrier comprises polyalkoxylated ether then the carrier further comprises at least one member of the group consisting of the polyalkoxylated phenol, and the polyalkoxylated amine; and (d) when the carrier comprises polyalkoxylated ester, the dispersant comprises polyalkylene amine.

2. The diesel fuel of claim 1, comprising the polyalkylene succinimide, wherein the polyalkylene succinimide is polyisobutylene succinimide containing from 10 to 60 isobutenyl groups.

3. The diesel fuel of claim 1, wherein the polyalkylene succinic anhydride from which the polyalkylene succinimide is made has the Formula I:

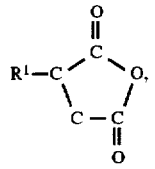

I wherein $R^1$ is a polyalkenyl radical having a weight from at least 600 to at most 3,000, the polyalkenyl radical contains from about 40 carbon atoms to about 300 carbon atoms.

4. The diesel fuel of claim 1, wherein the polyalkylene amine is polyisobutylene amine.

5. The diesel fuel of claim 1, comprising the polyalkylene amine, wherein the polyalkylene amine comprises a compound of Formula V:

$$R^3NH\text{-}(CH_2CHNH)_n\text{-}R^4, \quad V$$

wherein, $R^2$ is selected from the group consisting of a hydrogen atom and an alkyl group having from 1 to 6 carbon atoms, $R^3$ is a polyalkenyl radical having a number average molecular weight of about 600 to about 3,000, $R^4$ is selected from the group consisting of H and a polyalkenyl radical having a number average molecular weight of about 600 to about 3,000, and n is an integer from 1 to about 6.

6. The diesel fuel of claim 5, wherein in the polyalkylene amine of the Formula V, $R^3$ is a polyalkenyl radical having a number average molecular weight of about 750 to about 2,200 and $R^4$ is selected from the group consisting of H and a polyalkenyl radical having a number average molecular weight of about 750 to about 2,200.

7. The diesel fuel of claim 1, comprising the polyalkoxylated ether, wherein the polyalkoxylated ether has the Formula VI:

$$R^5—(R^6—O)_u—R^7 \quad \text{VI}$$

wherein, $R^5$ is a member selected from the group consisting of a hydrogen, alkoxy, cycloalkoxy, hydroxy, amino, hydrocarbyl, amino-substituted hydrocarbyl, and hydroxy-substituted hydrocarbyl group, each $R^6$ is independently an alkylene group having 2–10 carbon atoms, $R^7$ is a member selected from the group consisting of a hydrogen, alkoxy, cycloalkoxy, hydroxy, amino, hydrocarbyl, amino-substituted hydrocarbyl, and hydroxy-substituted hydrocarbyl group, and u is an integer from 1 to about 500.

8. The diesel fuel of claim 7, wherein, $R^5$ is a member selected from the group consisting of a hydrogen, alkyl having from 1 to 6 carbon atoms, and hydroxy-substituted hydrocarbyl group having from 1 to 6 carbon atoms, $R^6$ is an alkylene group having 2–4 carbon atoms, $R^7$ is a member selected from the group consisting of a hydrogen and alkyl having from 10 to 18 carbon atoms, and u is an integer from 3 to about 120.

9. The diesel fuel of claim 1, comprising the polyalkoxylated phenol.

10. The diesel fuel of claim 9, wherein $R^8$ is selected from the group consisting of hydrogen, and alkyl having from 8 to 12 carbon atoms, $R^9$ is selected from the group consisting of hydrogen or alkyl having 1 to 2 carbon atoms, w is an integer from 10 to about 40.

11. The diesel fuel of claim 1, comprising the polyalkoxylated ester, wherein the polyalkoxylated ester has the Formula X:

$$R^{11}—\overset{\overset{\displaystyle O}{\|}}{C}—O(CH_2CHR^{10}O)_xX, \quad \text{X}$$

wherein X is selected from the group consisting of H and $C_1$ to $C_{16}$ alkyl, x is an integer from 1 to about 500, $R^{10}$ is selected from the group consisting of H and $C_1$ to $C_4$ alkyl, and $R^{11}$ is selected from the group consisting of H, $C_1$ to $C_{14}$ alkyl, and a moiety of Formula XI:

$$—\overset{\overset{\displaystyle R^{12}}{|}}{C}=\overset{\overset{\displaystyle R^{13}}{|}}{C}—\overset{\overset{\displaystyle O}{\|}}{C}—O(CH_2CHR^{14}O)_yY. \quad \text{XI}$$

wherein at most one of $R^{12}$ and $R^{13}$ is hydrogen and at least one of $R^{12}$ and $R^{13}$ is selected from the group consisting of alkyl, aryl, arylalkyl, and alkenyl groups of 2 to about 18 carbon atoms, $R^{14}$ is selected from the group consisting of H and $C_1$ to $C_4$ alkyl, Y is selected from the group consisting of H and $C_1$–$C_{18}$ alkyl, and y is an integer from 1 to about 10.

12. The diesel fuel of claim 11, wherein at least one of $R^{12}$ and $R^{13}$ is selected from the group consisting of alkyl, aryl, arylalkyl, and alkenyl groups of about 8 to about 12 carbon atoms, $R^{14}$ is selected from the group consisting of H and $C_1$–$C_2$ alkyl, Y is selected from the group consisting of H and $C_8$–$C_{12}$ alkyl, and y is an integer from 2 to about 6.

13. The diesel fuel of claim 1, comprising the polyalkoxylated amine, wherein the polyalkoxylated amine has the Formula XIII:

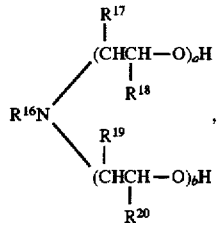

XIII wherein $R^{17}$, $R^{18}$, $R^{19}$ and $R^{20}$ are each selected from the group consisting of hydrogen and an alkyl group containing 1 to about 7 carbon atoms, a and b are independently an integer from 1 to about 75, and $R^{16}$ is selected from the group consisting of an alkyl group and an alkenyl group containing from about 8 to about 30 carbon atoms and a radical of Formula XIV:

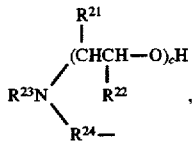

XIV wherein $R^{23}$ is an alkyl or alkenyl group containing from about 8 to about 30 carbon atoms, $R^{24}$ is an alkylene group containing from 2 to about 6 carbon atoms, $R^{21}$ and $R^{22}$ are each hydrogen or an alkyl group which contains up to about 7 carbon atoms, and c is an integer from 1 to about 75.

14. The diesel fuel of claim 13, wherein $R^{17}$, $R^{18}$, $R^{19}$ and $R^{20}$ are selected from the group consisting of hydrogen and methyl, a and b are independently an integer from 1 to about 10, and $R^{16}$ is selected from the group consisting of an alkyl group and an alkenyl group containing from about 10 to about 25 carbon atoms, and the radical of Formula XIV:

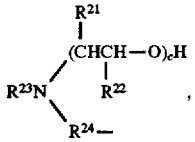

XIV wherein $R^{23}$ is an alkyl or alkenyl radical containing from about 10 to about 25 carbon atoms, $R^{24}$ is an ethylene, propylene or trimethylene radical, $R^{21}$ and $R^{22}$ are independently hydrogen or methyl, wherein at most one member of the group consisting of $R^{21}$ and $R^{22}$ is methyl, and c is independently an integer from 1 to about 10.

15. The diesel fuel of claim 1, wherein the carrier is a liquid carrier and the weight ratio of carrier to dispersant, on an active ingredient basis, ranges from about 0.3:1 to about 2:1, and the diesel fuel contains, on an active ingredient basis, an amount of the dispersant in the range of about 50 to about 200 ppmw and, on an active ingredients basis, an amount of the carrier in the range of about 50 ppmw to about 200 ppmw.

16. The diesel fuel of claim 15, wherein the weight ratio of carrier to dispersant, on an active ingredient basis, ranges from about 0.5:1 to about 1:1, and the diesel fuel contains, on an active ingredient basis, an amount of the dispersant in the range of about 70 to about 170 ppmw and an amount of the carrier in the range of about 50 ppmw to about 100 ppmw.

17. A diesel fuel additive comprising a mixture of:

a dispersant and a carrier;

the dispersant comprises at least one member of the group consisting of polyalkylene succinimides and polyalkylene amines, the polyalkylene succinimides being the reaction product of polyalkylene succinic anhydride and a first amine selected from the group consisting of polyamine, the polyalkylene amine being the reaction product of a polyalkylene moiety and a second amine selected from the group consisting of ammonia, monoamine and polyamine;

the carrier comprising at least one oxygenate selected from the group consisting of polyalkoxylated ether, polyalkoxylated phenol, polyalkoxylated ester and polyalkoxylated amine, wherein the polyalkoxylated phenol has the Formula VII:

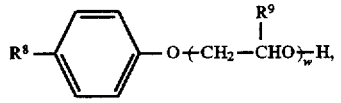

VII wherein $R^8$ is selected from the group consisting of hydrogen and alkyl having from 1 to 12 carbon atoms, each $R^9$ is independently selected from the group consisting of hydrogen or alkyl having 1 to 6 carbon atoms, w is an integer from 2 to 50; wherein (a) when the carrier comprises polyalkoxylated amine, the dispersant comprises polyalkylene amine;

(b) when the dispersant comprises the polyalkylene succinimide, in the absence of the polyalkylene amine, and the carrier comprises polyalkoxylated ether, the additive has an absence of a polymer or copolymer of an olefinic hydrocarbon or an absence of ester;

(c) when the dispersant is polyalkylene amine in the absence of polyalkylene succinimide and the carrier comprises polyalkoxylated ether then the carrier further comprises at least one member of the group consisting of the polyalkoxylated phenol, and the polyalkoxylated amine; and (d) when the carrier comprises polyalkoxylated ester, the dispersant comprises polyalkylene amine.

18. The diesel fuel additive of claim 17, comprising the polyalkylene succinimide, wherein the polyalkylene succinimide is polyisobutylene succinimide containing from 10 to 60 isobutenyl groups.

19. The diesel fuel additive of claim 17, wherein the polyalkylene succinic anhydride from which the polyalkylene succinimide is made has the Formula I:

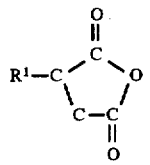

I wherein $R^1$ is a polyalkenyl radical having a weight from at least 600 to at most 3,000, the polyalkenyl radical contains from about 40 carbon atoms to about 300 carbon atoms.

20. The diesel fuel additive of claim 17, wherein the polyalkylene amine is polyisobutylene amine.

21. The diesel fuel additive of claim 17, comprises the polyalkylene amine, wherein the polyalkylene amine comprises a compound of Formula V:

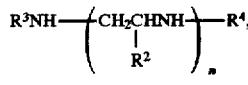

V wherein, $R^2$ is a hydrogen atom or an alkyl group having from 1 to 6 carbon atoms, $R^3$ is a polyalkenyl radical having a number average molecular weight of about 600 to about 3,000, $R^4$ is H or a polyalkenyl radical having a number average molecular weight of about 600 to about 3,000, and n is an integer from 1 to about 6.

22. The diesel fuel additive of claim 21, wherein in the polyalkylene amine of the Formula V, $R^3$ is a polyalkenyl radical having a number average molecular weight of about 750 to about 2,200.

23. The diesel fuel additive of claim 17, comprising the polyalkoxylated ether, wherein the polyalkoxylated ether has the Formula VI:

$$R^5-(R^6-O)_u-R^7 \qquad \text{VI,}$$

wherein $R^5$ is a member selected from the group consisting of a hydrogen, alkoxy, cycloalkoxy, hydroxy, amino, hydrocarbyl, amino-substituted hydrocarbyl, and hydroxy-substituted hydrocarbyl group, each $R^6$ is independently an alkylene group having 2–10 carbon atoms, $R^7$ is a member selected from the group consisting of a hydrogen, alkoxy, cycloalkoxy, hydroxy, amino, hydrocarbyl, amino-substituted hydrocarbyl, and hydroxy-substituted hydrocarbyl group, and u is an integer from 1 to about 500.

24. The diesel fuel additive of claim 23, wherein, $R^5$ is a member selected from the group consisting of a hydrogen, alkyl having from 1 to 6 carbon atoms, and hydroxy-substituted hydrocarbyl group having from 1 to 6 carbon atoms, $R^6$ is an alkylene group having 2–4 carbon atoms, $R^7$ is a member selected from the group consisting of a hydrogen and alkyl having from 10 to 18 carbon atoms, and u is an integer from 3 to about 120.

25. The diesel fuel additive of claim 17, comprising the polyalkoxylated phenol.

26. The diesel fuel additive of claim 25, wherein $R^8$ is selected from the group consisting of hydrogen, and alkyl having from 8 to 12 carbon atoms, $R^9$ is selected from the group consisting of hydrogen or alkyl having 1 to 2 carbon atoms, w is an integer from 10 to about 40.

27. The diesel fuel additive of claim 17, comprising the polyalkoxylated ester, wherein the polyalkoxylated ester has the Formula X:

$$R^{11}-\overset{\overset{\displaystyle O}{\|}}{C}-O(CH_2CHR^{10}O)_xX, \qquad \text{X}$$

wherein X is selected from the group consisting of H and $C_1$ to $C_{16}$ alkyl, x is an integer from 1 to 500, $R^{10}$ is selected from the group consisting of H and $C_1$ to $C_4$ alkyl, and $R^{11}$ is selected from the group consisting of H, $C_1$ to $C_{14}$ alkyl, and a moiety of Formula XI:

$$-\overset{\overset{\displaystyle R^{12}}{|}}{C}=\overset{\overset{\displaystyle R^{13}}{|}}{C}-\overset{\overset{\displaystyle O}{\|}}{C}-O(CH_2CHR^{14}O)_yY \qquad \text{XI.}$$

wherein at most one of $R^{12}$ and $R^{13}$ is hydrogen and at least one of $R^{12}$ and $R^{13}$ is selected from the group consisting of alkyl, aryl, arylalkyl, and alkenyl groups of 2 to 18 carbon atoms, $R^{14}$ is selected from the group consisting of H and $C_1$ to $C_4$ alkyl, Y is selected from the group consisting of H and $C_1$–$C_{18}$ alkyl, and y is an integer from 1 to about 10.

28. The diesel fuel additive of claim 27, wherein at least one of $R^{12}$ and $R^{13}$ is selected from the group consisting of alkyl, aryl, arylalkyl, and alkenyl groups of about 8 to about 12 carbon atoms, $R^{14}$ is selected from the group consisting of H and $C_1$–$C_2$ alkyl, Y is selected from the group consisting of H and $C_8$–$C_{12}$ alkyl, and y is an integer from 2 to about 6.

29. The diesel fuel additive of claim 17, comprising the polyalkoxylated amine, wherein the polyalkoxylated amine has the Formula XIII:

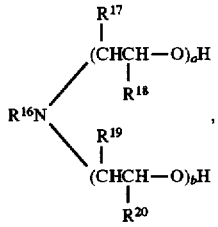

XIII wherein $R^{17}$, $R^{18}$, $R^{19}$ and $R^{20}$ are each selected from the group consisting of hydrogen and an alkyl group containing 1 to about 7 carbon atoms, a and b are independently an integer from 1 to about 75, and $R^{16}$ is selected from the group consisting of an alkyl group and an alkenyl group containing from about 8 to about 30 carbon atoms and a radical of Formula XIV:

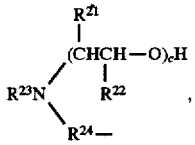

XIV wherein $R^{23}$ is an alkyl or alkenyl group containing from about 8 to about 30 carbon atoms, $R^{24}$ is an alkylene group containing from 2 to about 6 carbon atoms, $R^{21}$ and $R^{22}$ are each hydrogen or an alkyl group which contains up to about 7 carbon atoms, and c is an integer from 1 to about 75.

30. The diesel fuel additive of claim 29, wherein $R^{17}$, $R^{18}$, $R^{19}$ and $R^{20}$ are selected from the group consisting of hydrogen and methyl, a and b are independently an integer from 1 to about 10, and $R^{16}$ is selected from the group consisting of an alkyl group and an alkenyl group containing from about 10 to about 25 carbon atoms, and the radical of Formula XIV:

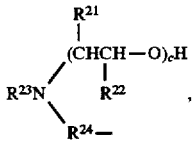

XIV wherein $R^{23}$ is an alkyl or alkenyl radical containing from about 10 to about 25 carbon atoms, $R^{24}$ is an ethylene, propylene or trimethylene radical, $R^{21}$ and $R^{22}$ are independently hydrogen or methyl, wherein at most one member of the group consisting of $R^{21}$ and $R^{22}$ is methyl, and c is independently an integer from 1 to about 10.

31. The diesel fuel additive of claim 17, wherein the carrier is a liquid carrier and the weight ratio of liquid carrier to dispersant, on an active ingredient basis, ranges from about 0.3:1 to about 2:1, and the additive concentrates of this invention contain from about 30 to about 80 weight percent dispersant on an active ingredient basis, and from about 20 to about 70 weight percent liquid carrier.

32. The diesel fuel additive of claim 17, wherein the weight ratio of liquid carrier to dispersant, on an active ingredient basis, ranges from about 0.5:1 to about 1:1, and the additive concentrates of this invention contain from about 50 to about 70 weight percent dispersant on an active ingredient basis, and from about 30 to about 50 weight percent liquid carrier.

33. A method for operating a compression ignition-internal combustion engine comprising the steps of:

supplying to and burning in the engine the diesel fuel composition of claim 1.

34. The method of claim 33, wherein the polyalkylene succinimide is a polyisobutylene succinimide and the polyalkylene amine is a polyisobutylene amine.

35. The method of claim 34, wherein the dispersant comprises the polyisobutylene succinimide and the oxygenate is selected from at least one member of the group consisting of polyalkoxylated ethers, polyalkoxylated phenols and polyalkoxylated amines;

wherein the polyalkoxylated ethers have the Formula VI:

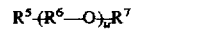

VI, wherein $R^5$ is a member selected from the group consisting of a hydrogen, alkoxy, cycloalkoxy, hydroxy, amino, hydrocarbyl, amino-substituted hydrocarbyl, and hydroxy-substituted hydrocarbyl group, each $R^6$ is independently an alkylene group having 2–10 carbon atoms, $R^7$ is a member selected from the group consisting of a hydrogen, alkoxy, cycloalkoxy, hydroxy, amino, hydrocarbyl, amino-substituted hydrocarbyl, and hydroxy-substituted hydrocarbyl group, and u is an integer from 1 to about 500; and wherein the polyalkoxylated amines have the Formula XIII:

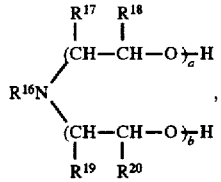

XIII wherein $R^{17}$, $R^{18}$, $R^{19}$ and $R^{20}$ are each selected from the group consisting of hydrogen and an alkyl group containing 1 to about 7 carbon atoms, a and b are independently an integer from 1 to about 75, and $R^{16}$ is selected from the group consisting of an alkyl group and an alkenyl group containing from about 8 to about 30 carbon atoms and a radical of Formula XIV:

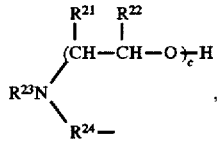

XIV wherein $R^{23}$ is an alkyl or alkenyl group containing from about 8 to about 30 carbon atoms, $R^{24}$ is an alkylene group containing from 2 to about 6 carbon atoms, $R^{21}$ and $R^{22}$ are each hydrogen or an alkyl group which contains up to about 7 carbon atoms, and c is an integer from 1 to about 75.

36. A method for the production of a diesel fuel having injector deposit inhibiting properties comprising the steps of:

providing a major portion of a pressure ignition engine fuel;

adding to the pressure ignition engine fuel a minor portion of a dispersant and a carrier;

the dispersant comprises at least one member of the group consisting of polyalkylene succinimides and polyalkylene amines, the polyalkylene succinimides being the reaction product of polyalkylene succinic anhydride and a first amine selected from the group consisting of polyamine, the polyalkylene amine being the reaction product of a polyalkylene moiety and a second amine selected from the group consisting of monoamine and polyamine;

the carrier comprising at least one oxygenate selected from the group consisting of polyalkoxylated ether, polyalkoxylated phenol, polyalkoxylated ester and polyalkoxylated amine, wherein the polyalkoxylated phenol has the Formula VII:

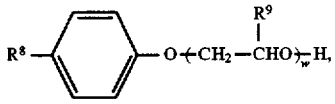

VII wherein $R^8$ is selected from the group consisting of hydrogen and alkyl having from 1 to 12 carbon atoms, each $R^9$ is independently selected from the group consisting of hydrogen or alkyl having 1 to 6 carbon atoms, w is an integer from 2 to 50; wherein (a) where the carrier comprises polyalkoxylated amine, the dispersant comprises polyalkylene amine;

(b) when the dispersant comprises the polyalkylene succinimide, in the absence of the polyalkylene amine, and the carrier comprises polyalkoxylated ether, the additive has an absence of a polymer or copolymer of an olefinic hydrocarbon or an absence of ester;

(c) when the dispersant is polyalkylene amine in the absence of polyalkylene succinimide and the carrier comprises polyalkoxylated ether then the carrier further comprises at least one member of the group consisting of the polyalkoxylated phenol, and the polyalkoxylated amine; and (d) when the carrier comprises polyalkoxylated ester, the dispersant comprises polyalkylene amine.

37. The method of claim 36, wherein the polyalkylene succinimide is a polyisobutylene succinimide and the polyalkylene amine is a polyisobutylene amine.

38. The method of claim 37, wherein the dispersant comprises the polyisobutylene succinimide and the oxygenate is selected from at least one member of the group consisting of polyalkoxylated ethers, polyalkoxylated phenols and polyalkoxylated amines;

wherein the polyalkoxylated ethers have the Formula VI:

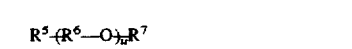

VI, wherein $R^5$ is a member selected from the group consisting of a hydrogen, alkoxy, cycloalkoxy, hydroxy, amino, hydrocarbyl, amino-substituted hydrocarbyl, and hydroxy-substituted hydrocarbyl group, each $R^6$ is independently an alkylene group having 2–10 carbon atoms, $R^7$ is a member selected from the group consisting of a hydrogen, alkoxy, cycloalkoxy, hydroxy, amino, hydrocarbyl, amino-substituted hydrocarbyl, and hydroxy-substituted hydrocarbyl group, and u is an integer from 1 to 500; and wherein the polyalkoxylated amines have the Formula XIII:

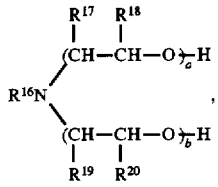

XIII wherein $R^{17}$, $R^{18}$, $R^{19}$ and $R^{20}$ are each selected from the group consisting of hydrogen and an alkyl group containing 1 to about 7 carbon atoms, a and b are independently an integer from 1 to about 75, and $R^{16}$ is selected from the group consisting of an alkyl group and an alkenyl group containing from about 8 to about 30 carbon atoms and a radical of Formula XIV:

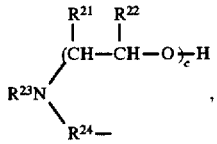

XIV wherein $R^{23}$ is an alkyl or alkenyl group containing from about 8 to about 30 carbon atoms, $R^{24}$ is an alkylene group containing from 2 to about 6 carbon atoms, $R^{21}$ and $R^{22}$ are each hydrogen or an alkyl group which contains up to about 7 carbon atoms, and c is an integer from 1 to about 75.

39. A product produced by the method of claim 36.

40. The diesel fuel of claim 1, wherein when the carrier comprises polyalkoxylated amine, then the carrier further comprises at least one member of the group consisting of the polyalkoxylated phenol, polyalkoxylated ester and the polyalkoxylated amine.

41. The diesel fuel additive of claim 17, wherein when the carrier comprises polyalkoxylated amine, then the carrier further comprises at least one member of the group consisting of the polyalkoxylated phenol, polyalkoxylated ester and the polyalkoxylated amine.

42. The method of claim 36, wherein when the carrier comprises polyalkoxylated amine, then the carrier further comprises at least one member of the group consisting of the polyalkoxylated phenol, polyalkoxylated ester and the polyalkoxylated amine.

* * * * *